US012234640B2

(12) United States Patent
Luo et al.

(10) Patent No.: US 12,234,640 B2
(45) Date of Patent: Feb. 25, 2025

(54) CABLE DOME STRUCTURE USING CONTINUOUS RIDGE CABLES

(71) Applicant: ZHEJIANG UNIVERSITY, Zhejiang (CN)

(72) Inventors: Yaozhi Luo, Hangzhou (CN); Yu Xue, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 18/673,327

(22) Filed: May 24, 2024

(65) Prior Publication Data

US 2024/0309638 A1 Sep. 19, 2024

Related U.S. Application Data

(63) Continuation of application No. PCT/CN2023/079558, filed on Mar. 3, 2023.

(30) Foreign Application Priority Data

Apr. 11, 2022 (CN) ..... 202210375671.0

(51) Int. Cl.
*E04B 7/14* (2006.01)

(52) U.S. Cl.
CPC ..... *E04B 7/14* (2013.01)

(58) Field of Classification Search
CPC ..... E04B 7/14
See application file for complete search history.

(56) References Cited

U.S. PATENT DOCUMENTS 4,736,553 A * 4/1988 Geiger ..... E04B 7/14 52/694
5,502,928 A 4/1996 Terry
2012/0159872 A1 6/2012 Zhuo et al.

FOREIGN PATENT DOCUMENTS

CN 102605861 A 7/2012
CN 103615064 A 3/2014
CN 105888065 A 8/2016
CN 105952049 A 9/2016
(Continued)

OTHER PUBLICATIONS

International Search Report (PCT/CN2023/079558); Date of Mailing: May 22, 2023.
(Continued)

*Primary Examiner* — Patrick J Maestri
(74) *Attorney, Agent, or Firm* — W&G Law Group

(57) ABSTRACT

Disclosed in the present invention is a cable dome structure using continuous ridge cables. A structure system includes n same plane trusses which are distributed in the radial direction and each consist of continuous cables and rods, the plane trusses being connected by means of k−1 circles of hoop cables to form a stable whole. The cable dome structure consists of ridge cables, hoop cables and pressing rods. Each ridge cable starts from a lower joint of a pressing rod and sequentially passes through upper joints of outer side pressing rods, and all the ridge cables converge on a support joint. The ridge cables have overlaps. Upper joints of the pressing rods and inner side adjacent cables are fixedly connected, and lower joints of the pressing rods and the hoop cables are fixedly connected, the cables slidably passing through the joints.

2 Claims, 3 Drawing Sheets

(56) References Cited

FOREIGN PATENT DOCUMENTS

| | | | |
|---|---|---|---|
| CN | 107034992 | A | 8/2017 |
| CN | 110700474 | A | 1/2020 |
| CN | 211548062 | U | 9/2020 |
| CN | 112459334 | A | 3/2021 |
| CN | 114856068 | A | 8/2022 |
| JP | 3137332 | A | 6/1991 |
| JP | 646429 | A | 2/1994 |
| JP | H11210083 | A | 8/1999 |

OTHER PUBLICATIONS

Notice of Allowance(CN202210375671.0); Date of Mailing: Nov. 22, 2022.
Morphology-Design-and-Analysis-of-Novel-Annular-Tensegrity-Dome-Structures.
Japanese Grant of Patent for Application No. 2024-518961, mailed Sep. 6, 2024,(6 pages).

* cited by examiner

CABLE DOME STRUCTURE USING CONTINUOUS RIDGE CABLES

CROSS-REFERENCE TO RELATED APPLICATIONS

The present application is a continuation of International Application No. PCT/CN2023/079558, filed on Mar. 3, 2023, which claims priority to Chinese Application No. 202210375671.0, filed on Apr. 11, 2022, the contents of both of which are incorporated herein by reference in their entireties.

TECHNICAL FIELD

The present application relates to the technical field of civil engineering and, in particular, to a cable dome structure with continuous ridge cables.

BACKGROUND

The cable dome structure is developed from the concept of a tensegrity structure, which forms a self-equilibrium stable system through pressed rods and tensioned cables. The cable dome structure is widely used to build the roof structures of long-span buildings due to its advantages of light weight, high efficiency, symmetry and beauty. Generally, the traditional cable dome structures include Levy cable domes and Geiger cable domes. In recent years, in order to meet the needs of various projects, designers have proposed a variety of new cable dome structure systems.

At present, most of the existing cable domes use discontinuous cables as structural members, with a large number of units and anchors and different the cable forces of each group, and the maximum cable force may often reach dozens of times of the minimum cable force, which leads to the complex structure and difficult construction of the existing cable domes, while using continuous cable energy is a feasible solution to solve the above problems. In the existing design of the cable dome structure, the internal force of the structure is usually determined under the condition the structure shape is given, and it is impossible to accurately control the prestress of the cable. However, the condition for using continuous cables is that the internal forces of adjacent cables are the same, thus the application of continuous cables in the existing cable dome structure is dramatically limited. At present, there is no cable dome structure using continuous cables as ridge cables.

SUMMARY

The object of the present application is to overcome the shortcomings of the prior art, and to propose a cable dome structure with continuous ridge cables. With the application of continuous ridge cables, the types and quantities of cables are greatly reduced, the number of anchors is reduced, and the construction difficulty of the cable dome structure is reduced.

The object of the present application is achieved through the following technical solution: a cable dome structure with continuous ridge cables, where the cable dome structure consists of n cable-rod plane trusses with continuous ridge cables as structural members distributed along a radial direction, and where a pressing rod at a center of the cable dome structure is shared by all cable-rod planes, and all cable-rod plane trusses are connected into a stable whole by k−1 circles of hoop cables; each cable-rod plane truss consists of k pressing rods, k+1 cables and one support joint; upper joints of the pressing rods are $u_1, u_2, \ldots, u_k$, respectively, from inside to outside, lower joints of the pressing rods are $d_1, d_2, \ldots, d_k$, respectively, from inside to outside, and the support joint is s, which is located at an outermost side of the cable-rod planes; a first ridge cable starts from $u_1$, connects $u_2, \ldots, u_k$ successively, and connects to the support joint s at last; a $t^{th}$ (t=2, 3, . . . , k) ridge cable starts from $d_{t-1}$, connects $u_t, \ldots, u_k$ successively, and connects to the support joint s at last; a $(k+1)^{th}$ ridge cable connects points $d_k$ and s; each circle of hoop cables is a regular n-polygon, which connects the lower joints of the pressing rods at the same position in n cable-rod planes, where the hoop cables from inside to outside are a first hoop cable, a second hoop cable, . . . , a $(k-1)^{th}$ hoop cable, respectively.

The cable dome structure consists of hoop cables, ridge cables and pressing rods. The hoop cables and part of the ridge cables of the structure adopt the construction of continuous ridge cables, that is, one cable connects multiple joints at the same time. The ridge cables overlap on the upper surface of the structure, and the number of overlapping layers increases from inside to outside in an arithmetic sequence. All the ridge cables are connected to the support joint of the structure.

Further, in order to meet the stability requirements of the structure, some of the connections between joints and continuous ridge cables in the cable dome structure are set as fixed connection. Specifically, the connections between the upper joints of the pressing rod and the inner adjacent ridge cables are fixed connections, and the connections between the lower joints of the pressing rods and the hoop cables are fixed connections, that is, the connection between the joint $u_i$ and an $i^{th}$ (i=1, 2, . . . , k) ridge cable is a fixed connection, and the connection between the joint $d_i$ and an $(i-1)^{th}$ (i=2, . . . ,k) hoop cable is a fixed connection; in the fixed connection mode, the cable cannot slide through the joint; the connections between the remaining continuous ridge cables and joints are not fixed; in the non-fixed connection mode, the cables can slide through the joints, which can make the internal forces between adjacent cable segments transfer to each other and reduce the peak value of the cable force change under a load.

Further, in order to meet the condition that continuous ridge cables can be used, it is necessary to accurately control the prestress of the cables in the initial state. Therefore, the form determination process of the cable dome structure is to determine the equilibrium state of the structure under the conditions of given cable force and rod length. In an initial equilibrium state with only self-weight, the prestresses of all ridge cables are the same, and the prestresses of all hoop cables are the same.

Further, the shape and mechanical properties of the structure can be further adjusted by changing other structural parameters, including the number of circles of the hoop cable, the ratio of the hoop cable prestress to the ridge cable prestress, the length of the pressing rod and the number of cable-rod plane trusses.

The present application has the beneficial effects that the number of cables and the number of anchoring joints in the cable dome structure are reduced through the application of continuous ridge cables; by determining the initial shape of the structure under a given cable force, a more uniform cable force distribution is realized, and there are only two kinds of initial prestress of cables in the structure, which reduces the types of cables; the required cable diameter is reduced through the overlapping distribution of ridge cables; all the ridge cables converge to the support joint through the novel joint connection mode. The above characteristics greatly reduce the difficulty of cable processing and tensioning during construction, and provide a convenient and feasible new cable dome structure system for structural designers.

DESCRIPTION OF EMBODIMENTS

The specific embodiments of the present application will be further described with reference to the accompanying drawings.

Figure 1:
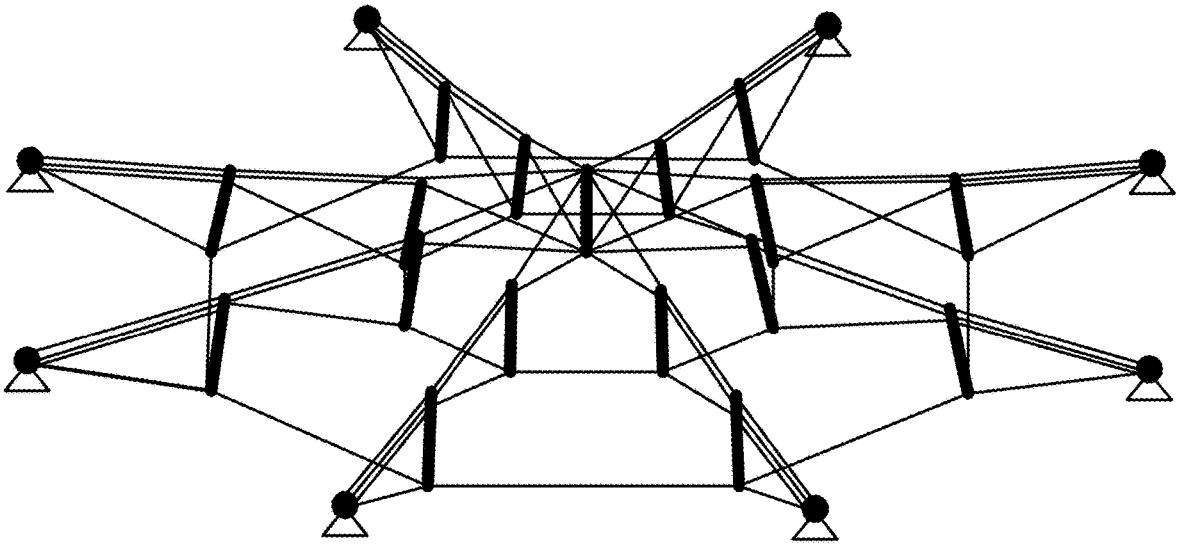
FIG. 1 is a schematic diagram of the overall shape of a cable dome structure in the present application, in which thick lines represent pressing rods and thin lines represent cables.

As shown in FIG. 1, the structural members are divided into three categories: hoop cables, ridge cables and pressing rods, and the tensioned hoop cables, ridge cables and pressing rods form an equilibrium stress system. The hoop cables and some of the ridge cables of the structure adopt the structure of continuous ridge cables, that is, one cable connects multiple joints at the same time. The structure can be regarded as composed of several cable-rod plane trusses distributed along the radial direction, and the cable-rod planes share the central pressing rod and are connected into a stable whole by hoop cables. The numbers of hoop cables, ridge cables and pressing rods are k−1, n(k+1) and n(k−1)+1, respectively, where k is the number of pressing rods in each cable-rod plane truss and n is the number of cable-rod plane trusses.

Figure 2:
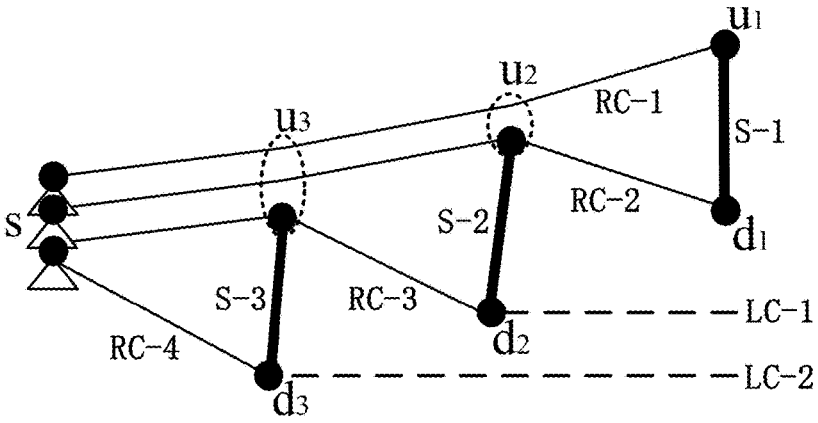
FIG. 2 is a schematic diagram of a single cable-rod plane structure of the cable dome structure in the present application, in which thick lines represent pressing rods, thin lines represent cables, and dotted lines represent the projections of the hoop cables in the plane, DC-x represents the number of ridge cables, LC-x represents the number of hoop cables, and S-x represents the number of pressing rods.

As shown in FIG. 2, each cable-rod plane truss consists of k pressing rods, k+1 ridge cables and one support joint. The upper joints of pressing rods are $u_1, u_2, \ldots, u_k$ from inside to outside, the lower joints of pressing rods are $d_1, d_2, \ldots, d_k$ from inside to outside, and the support joint is s. The first ridge cable starts from $u_1$, connects $u_2, \ldots, u_k$ in turn, and finally connects to the support joint s; the $t^{th}$ (t=2, 3, . . . , k) ridge cable starts from $d_{t-1}$, connects $u_t, \ldots, u_k$ in turn, and finally connects to the support joint s; the $(k+1)^{th}$ ridge cable is directly connected to the support joint s by the joint $d_k$.

Figure 3:
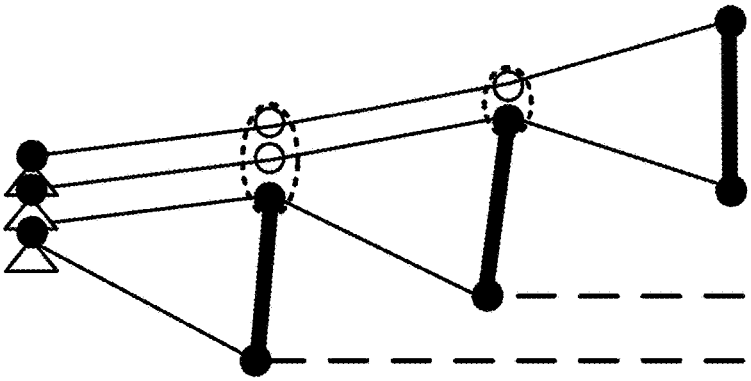
FIG. 3 is a schematic diagram of the connections between the cable dome joint and the continuous ridge cables in the present application, in which the thick lines represent the pressing rods, the thin lines represent the cables, and the dotted lines represent the projections of the hoop cables in the cable-rod plane; the solid black dot in the FIG. represents a fixed connection mode, and the hollow black dot represents a non-fixed connection mode.

As shown in FIG. 3, in the cable dome structure of the present application, in order to meet the stability requirements of the structure, part of the connections between continuous ridge cables and joints is fixed, while the other part is not fixed. Specifically, the connection between the joint $u_i$ and the $i^{th}$ (i=1, 2, . . . , k) ridge cable is a fixed connection, and the connection between the joint $d_i$ and the $(i-1)^{th}$ (i=2, . . . , k) hoop cable is a fixed connection; the connections between the other continuous ridge cables and joints are not fixed, and the cables can slide through the joints, which can make the internal forces between adjacent cable segments transfer to each other and reduce the peak value of the cable force change under a load.

Figure 4:
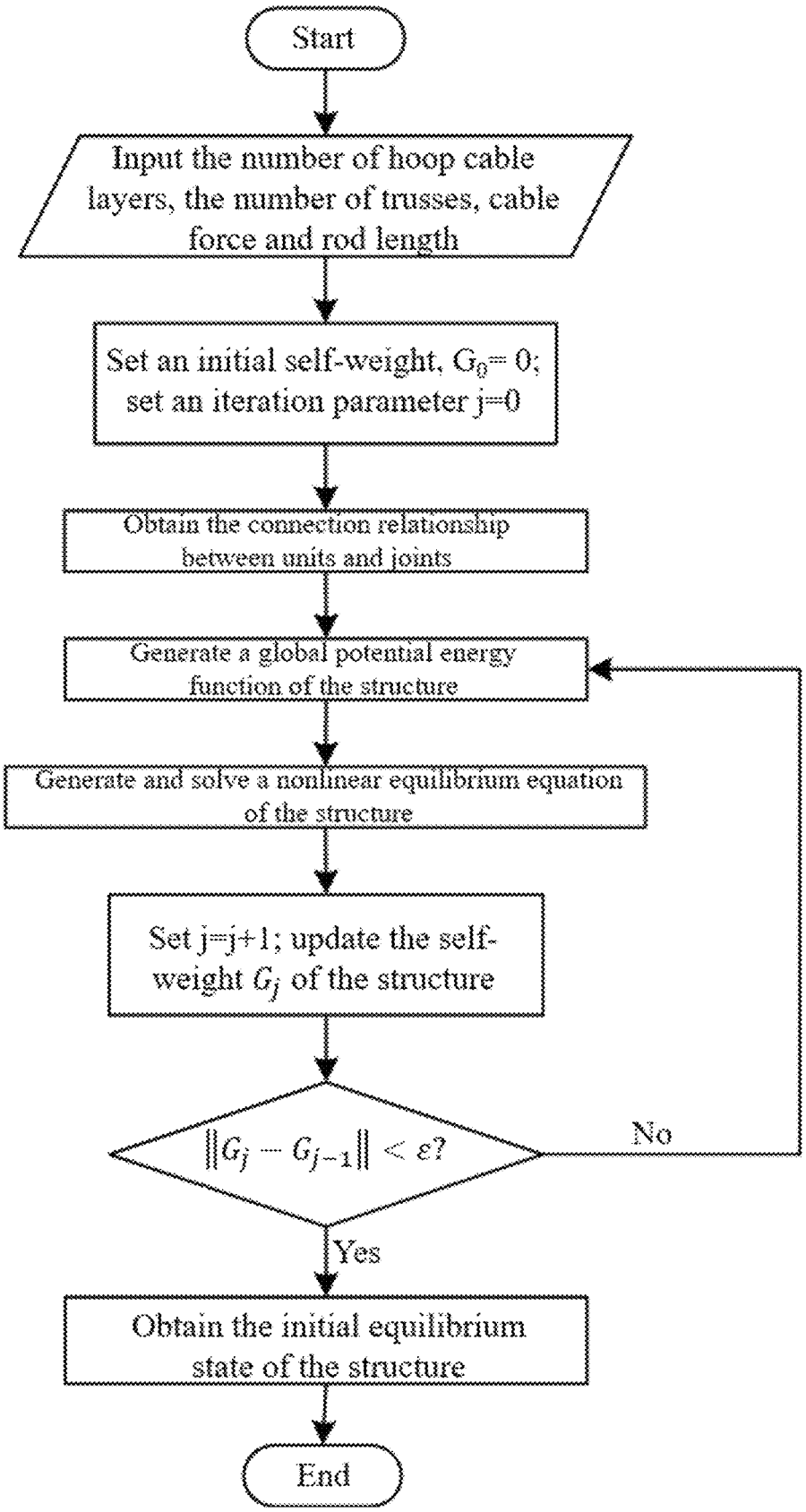
FIG. 4 is a flowchart of a method for determining the initial shape of a cable dome structure in the present application.

Different from the traditional cable dome structure, for which the cable force is determined under a given shape, in order to meet the condition that continuous ridge cables can be used, it is necessary to accurately control the prestress of cables in the initial state. In the cable dome structure of the present application, it needs to determine the initial equilibrium state of the structure under a given cable force; in the initial equilibrium state with only self-weight, the prestresses of all ridge cables are the same, and the prestresses of all hoop cables are the same. FIG. 4 shows the flow chart for determining the initial form of the structure according to the present application, and the specific steps are as follows.

Firstly, the equilibrium equation of the system is constructed according to the principle of stationary potential energy, and the potential energy function of continuous ridge cables with a given cable force is $$\pi_1^p(x) = t_p l_p(x)$$

where $\pi_1^p(x)$ is the potential energy function of the $p^{th}$ ridge cable, $t_p$ is the internal force of the $p^{th}$ ridge cable, x is the coordinates of the joint connected by the $p^{th}$ ridge cable, and $l_p(x)$ is the length of the $p^{th}$ ridge cable; $l_p(x)$ can be expressed as $$l_p(x) = \sum_{i=2}^{r} \sqrt{\left(x_p^i - x_p^{i-1}\right)^T \left(x_p^i - x_p^{i-1}\right)}$$

where $x_p^i$ is the coordinate vector of the $i^{th}$ joint connected by the $p^{th}$ ridge cable, and r is the number of joints connected by the $p^{th}$ ridge cable.

The potential energy function of the pressing rod is $$\pi_2^q(x) = \frac{1}{2}\frac{E_q A_q}{l_q^0}\left(l_q(x) - l_q^0\right)^2$$

where $\pi_2^q(x)$ is the potential energy function of the $q^{th}$ pressing rod, $E_q$, $A_q$ are the Young's modulus and cross-sectional area of the $q^{th}$ pressing rod, $l_q^o$ is the initial length of the $q^{th}$ pressing rod and $l_q(x)$ is the length of the $q^{th}$ pressing rod after deformation.

The potential energy function corresponding to the external load of the structure is $$\pi_3^m = -f_m x_m$$

where $f_m$ is a load acting on the degree of freedom m and $x_m$ is the joint coordinate corresponding to the degree of freedom m.

The overall potential energy function of the cable dome structure is $$\prod_1(x) = \sum_{p\in\{C\}} \pi_1^p(x) + \sum_{q\in\{S\}} \pi_2^q(x) + \sum_{m\in\{F\}} \pi_3^m(x)$$

where {C} is a set of cables, {S} is a set of rods and {F} is a set of degrees of freedom with a load.

According to the principle of stationary potential energy, the equilibrium equation of the structure can be expressed as $$\frac{\partial \prod_1(x)}{\partial x} = 0$$

This is a nonlinear equation group, and there is no analytical solution to this equation group, which can be solved by a numerical optimization algorithm, such as the Levenberg-Marquardt algorithm.

The self-weight of the cable dome structure is unknown in advance, and the self-weight load of the structure can only be determined after the initial shape is determined. The self-weight load of the structure needs to be iteratively updated in the solution process until the convergence condition is reached.

After the initial shape of the structure is determined, the geometric length of a deformed member is calculated according to the coordinates of all joints in the initial form of the structure, and the initial geometric length of the member is determined according to the stiffness and internal force of the member. The calculation formula of the initial geometric length is as follows $$l_q^0 = \frac{E_q A_q \overline{l_q}}{E_q A_q + \overline{t_q}}$$

where $\overline{l_q}$ is the length of the $q^{th}$ pressing rod after deformation, and $\overline{t_q}$ is the internal force for constructing the $q^{th}$ pressing rod.

The members processed according to the initial geometric lengths are assembled together through hinged joints according to the connection relationship described by the cable dome structure of the present application, and the structure is enabled to reach the set prestress equilibrium state by stretching the ridge cables at the support joint.

The shape and mechanical properties of the structure can be further adjusted by changing other structural parameters, including the number of hoop cables, the ratio of the hoop cable prestress to the ridge cable prestress, the length of pressing rods and the number of cable-rod plane trusses.

Figure 5:
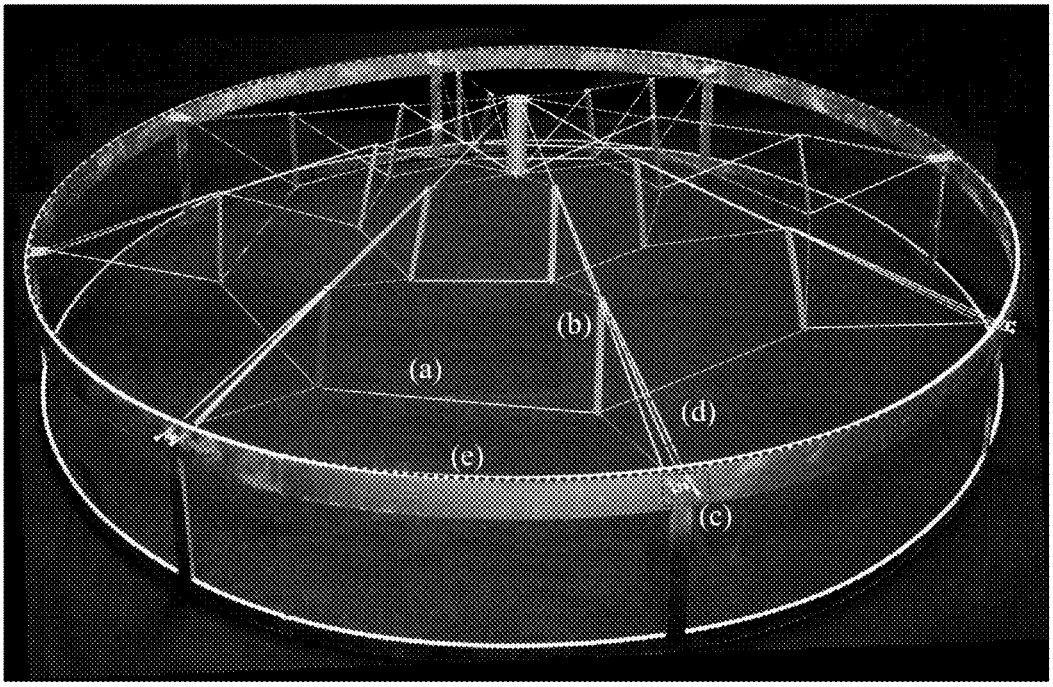
FIG. 5 is a physical model of the cable dome structure after installation and tensioning.

As shown in FIG. 5, it is a physical model diagram of the cable dome structure of the present application, which consists of 8 cable-rod planes and 2 circles of hoop cables (n=8, k=3). The number of pressing rods in the structure is 17, and the number of ridge cables is 32, in which (a) is continuous cables, (b) is pressing rods, (c) is tension bolts, and (4) is overlapping distribution of ridge cables. The cables and rods in the physical model are made of nylon wire and aluminum alloy respectively. By adjusting the length of bolts at the support joint, the tensioning and forming of the structure is realized.

The above-mentioned embodiments are used to explain the present application, but not to limit the present application. Any modification and change made to the present application within the scope of protection of the spirit and claims of the present application fall within the scope of protection of the present application.

What is claimed is:

1. A cable dome structure with continuous ridge cables, wherein the cable dome structure consists of n cable-rod plane trusses with continuous ridge cables as structural members distributed along a radial direction, and wherein a pressing rod at a center of the cable dome structure is shared by all cable-rod planes, and all cable-rod plane trusses are connected into a stable whole by k−1 circles of hoop cables; each cable-rod plane truss consists of k pressing rods, k+1 cables and one support joint; upper joints of the pressing rods are $u_1, u_2, \ldots, u_k$, respectively, from inside to outside, lower joints of the pressing rods are $d_1, d_2, \ldots, d_k$, respectively, from inside to outside, and the support joint is s, which is located at an outermost side of the cable-rod planes; a first ridge cable starts from $u_1$, connects $u_2, \ldots, u_k$ successively, and connects to a support joint s at last; a $t^{th}$ ridge cable starts from $d_{t-1}$, connects $u_t, \ldots, u_k$ successively, and connects to the support joint s at last, wherein t=2,3, . . . , k; a (k+1)th ridge cable connects points $d_k$ and s; each circle of hoop cables is a regular n-polygon, which connects the lower joints of the pressing rods at a same position in n cable-rod planes, wherein the hoop cables from inside to outside are a first hoop cable, a second hoop cable, . . . , a $(k-1)^{th}$ hoop cable, respectively;

wherein in connections between pressing rod joints and the continuous ridge cables of the cable dome structure, a connection between a joint $u_i$ and an $i^{th}$ (i=1,2, . . . , k) ridge cable is a fixed connection, and a connection between a joint $d_1$ and an $(i-1)^{th}$ (i=2, . . . , k) hoop cable is a fixed connection; connections between remaining continuous ridge cables and the upper joints of the pressing rods are not fixed, the remaining continuous ridge cables cannot slide through the upper joints in a fixed connection mode, and the remaining continuous ridge cables pass through the upper joints in a non-fixed connection mode to form slideable connections, in such a manner that a deformation between adjacent cable segments is transferred to each other, and internal forces between the adjacent cable segments changes uniformly; and wherein an equilibrium state of the cable dome structure is determined under a condition that a cable force and a rod length are given, in response to a fact that the cable dome structure is in an initial equilibrium state with only self-weight, prestresses of all continuous ridge cables are the same, and prestresses of all hoop cables are the same; and an initial shape of the cable dome structure is capable of being changed by altering a prestress ratio of the hoop cables to the continuous ridge cables.

2. The cable dome structure with continuous ridge cables according to claim 1, wherein in each cable-rod plane truss, the continuous ridge cables overlap on an upper surface of the cable dome structure, and a number of overlapping layers increases from inside to outside in an arithmetic sequence, and the number of overlapping layers between a joint $u_i$ and a joint $u_{i+1}$ is i, wherein i=2,3, . . . , k.

* * * * *